US009512369B1

(12) United States Patent
Noble et al.

(10) Patent No.: US 9,512,369 B1
(45) Date of Patent: Dec. 6, 2016

(54) PROCESS FOR REMOVING COLOR BODIES FROM USED OIL

(71) Applicants: James Joseph Noble, Cary, NC (US); Percy Norman Glynn, Pittsboro, NC (US)

(72) Inventors: James Joseph Noble, Cary, NC (US); Percy Norman Glynn, Pittsboro, NC (US)

(73) Assignee: James Joseph Noble, Cary, NC (US)

( * ) Notice: Subject to any disclaimer, the term of this patent is extended or adjusted under 35 U.S.C. 154(b) by 289 days.

(21) Appl. No.: 14/209,471

(22) Filed: Mar. 13, 2014

Related U.S. Application Data

(60) Provisional application No. 61/783,677, filed on Mar. 14, 2013.

(51) Int. Cl.

| | |
|---|---|
| ***C10G 29/20*** | (2006.01) |
| *C10G 29/00* | (2006.01) |
| *C10G 29/02* | (2006.01) |
| *C10G 21/00* | (2006.01) |
| *C10G 21/02* | (2006.01) |
| *C10G 21/12* | (2006.01) |
| *C10G 21/16* | (2006.01) |
| *C10G 21/20* | (2006.01) |

(52) U.S. Cl.
CPC ..... *C10G 29/20* (2013.01)

(58) Field of Classification Search
CPC ..... C10G 21/00; C10G 21/02; C10G 21/12; C10G 21/16; C10G 21/20; C10G 29/00; C10G 29/02; C10G 29/20
See application file for complete search history.

(56) References Cited

U.S. PATENT DOCUMENTS

| | | | | |
|---|---|---|---|---|
| 3,451,925 | A | 6/1969 | Morris et al. | |
| 3,461,066 | A | 8/1969 | Morris et al. | |
| 3,470,089 | A | 9/1969 | Morris et al. | |
| 4,013,549 | A | 3/1977 | Bushnell | |
| 4,057,491 | A | 11/1977 | Bushnell et al. | |
| 4,328,092 | A | 5/1982 | Sequeira, Jr. | |
| 4,345,976 | A | 8/1982 | Peter et al. | |
| 4,498,980 | A | 2/1985 | Forte | |
| 4,594,148 | A | 6/1986 | Hosler | |
| 4,781,820 | A | 11/1988 | Forte | |
| 5,039,399 | A | 8/1991 | Sequeira, Jr. | |
| 5,041,206 | A | 8/1991 | Sequeira, Jr. | |
| 5,178,750 | A | 1/1993 | Mead | |
| 5,306,419 | A | 4/1994 | Harrison et al. | |
| 5,689,033 | A | 11/1997 | Forte et al. | |
| 6,068,759 | A | 5/2000 | Moore et al. | |
| 6,117,309 | A | 9/2000 | Daspit et al. | |
| 6,358,402 | B1 | 3/2002 | Schucker | |
| 6,372,122 | B1 | 4/2002 | Gorman | |
| RE38,366 | E | 12/2003 | Kenton | |
| 2004/0182750 | A1 * | 9/2004 | Khanna | C10G 53/04 208/326 |
| 2010/0176025 | A1 | 7/2010 | Kumar et al. | |

* cited by examiner

*Primary Examiner* — Brian McCaig
(74) *Attorney, Agent, or Firm* — Coats & Bennett, P.L.L.C.

(57) ABSTRACT

Methods and systems of removing color bodies from vacuum gas oil. The methods and systems include mixing the oil and N-Methyl-2-pyrrolidone (NMP) within one or more columns. After moving through the one or more columns, water and glycerin are added to the oil. A second portion of the NMP is removed from the oil as well as at least some of the water and at least some of the glycerin through at least one centrifuge.

18 Claims, 7 Drawing Sheets

PROCESS FOR REMOVING COLOR BODIES FROM USED OIL

CROSS-REFERENCE TO RELATED APPLICATIONS

This application claims the benefit of U.S. Provisional Application No. 61/783,677 entitled Process for Removing Color Bodies from Used Oil that was filed on Mar. 14, 2013.

BACKGROUND

Various processes have been developed to remove impurities from used oil. These processes include mixing the oil with a variety of different materials to remove impurities. The processes also include a variety of different structures that introduce the materials, mixing the oil and materials, heating and/or cooling the oil and materials, and other steps that ultimately result in a higher grade oil at the end of the processes.

These processes are often quite expensive and add a large cost to the improved oil. The high costs may be attributed to the type and amount of materials that are added to the oil. Additional costs may be caused by the amount of heating and cooling of the oil and materials required during the process. Further, the costs may also result from the amount and/or type of equipment needed to perform the various steps of the processes.

Another drawback to previous processes is the excessive amount of time necessary for completion. One or more of the various steps result in an excessive amount of time necessary between the initial introduction of the used oil in the process until the output of the end product. The processes are further developed in a manner that makes it difficult to shorten the necessary time.

SUMMARY

The present application is directed to processes of removing color bodies from used oil.

One embodiment is directed to a method of removing color bodies from vacuum gas oil. The method includes mixing the oil and N-Methyl-2-pyrrolidone (NMP) within one or more columns, removing a first portion of the NMP from the oil by movement through the one or more columns, after moving through the one or more columns, adding water and glycerin to the oil, and removing a second portion of the NMP, at least some of the water, and at least some of the glycerin from the oil through at least one centrifuge.

The method may also include adding the water to the oil; moving the oil with the water through a first one of the at least one centrifuges and removing additional parts of the NMP from the oil; thereafter, adding the glycerin to the oil; and moving the oil with the glycerin through a second one of the at least one centrifuges and removing more of the NMP from the oil.

The method may also include adding the water and chilling the oil to between 50° F.-100° F.; and removing the second portion of the NMP and a first portion of the water from the oil with the first one of the at least one centrifuge.

The method may also include adding a demulsifier to the oil when adding the water.

The method may also include moving the oil from a first location such as a storage tank or from production to the one or more columns while preventing contact between the oil and oxygen.

The method may also include moving the oil and the NMP through an incline plate clarifier and removing an additional amount of the NMP prior to adding the water and the glycerin.

Another embodiment is directed to a method of removing color bodies from vacuum gas oil. The method includes: introducing the oil into a first inlet at a lower section of a contactor column; introducing N-Methyl-2-pyrrolidone (NMP) into a second inlet at an upper section of the contactor column, the NMP being more dense than the oil; mixing the oil and the NMP along the contactor column with an agitating member that moves in upward and downward directions along a height of the contactor column, the agitating member including a shaft and radial discs spaced apart along the height of the contactor column; moving non-solubilized material in the oil upward in the contactor column and into a capture area at the upper section, the capture area being positioned above the agitating member and including a greater width than the contactor column along the agitating member; reducing a velocity of the non-solubilized material in the oil in the capture area with the non-solubilized material settling into a lower section of the contactor column; removing the treated oil from the upper section of the capture area, the treated oil including a residual amount of NMP; after the treated oil is removed, mixing glycerin and water to the oil with the glycerin being at a temperature of between 80° F.-220° F.; and removing an additional amount of the NMP and at least some of the glycerin and the water from the oil with a first centrifuge.

The method may include within the contactor column moving the oil and NMP through openings in the discs and along peripheral openings formed between a wall of the contactor column and an outer end of the radial discs.

The method may include a ratio of oil to NMP introduced into the contactor column ranges from between 6:1 to 1:2.

The method may include moving the non-solubilized material along an angled lower member of the capture area towards an outlet.

The method may include removing a majority of the NMP that was introduced into the second inlet from the lower section of the contactor column.

The method may include moving the oil through a second contactor column prior to mixing the glycerin and the water with the oil.

The method may include moving the oil from a first location such as a storage tank or from production to the contactor column while preventing contact between the oil and oxygen.

The method may include moving the non-solubilized material in the oil in the contactor column vertically above the second inlet and removing the oil from the contactor column at a point vertically above the second inlet.

Another embodiment is directed to a method of removing color bodies from vacuum gas oil. The method includes: mixing the oil with a first amount of NMP in a first contactor column and mixing the oil and the NMP with the oil moving upward through the first contactor column and the NMP moving downward through the first contactor column; removing the oil from an upper section of the first contactor column and introducing the oil into a second contactor column, the oil including a first amount of the NMP; mixing the oil in the second contactor column with a second greater ratio of NMP and mixing the oil and the NMP with the oil moving upward through the second contactor column and the NMP moving downward through the second contactor column; removing the oil that includes a second amount of NMP from an upper section of the second contactor column;

mixing the oil that includes the second amount of NMP with water and a demulsifier within a first tank and cooling to a temperature of between 50° F.-100° F.; moving the first tank contents into a first centrifuge and removing at least a portion of the NMP and at least a portion of the water from the oil; mixing contents of the first centrifuge with glycerin and heating to a temperature of between 150° F.-200° F.; and removing at least a portion of the glycerin and at least a portion of the water from the oil with a second centrifuge.

The method may include the water comprising 15% of the first tank contents.

The method may include cooling the first tank contents to a temperature of 70° F. prior to moving the first tank contents to the first centrifuge.

The method may include moving the oil from the second centrifuge into a finished oil storage tank.

Another embodiment includes introducing a vacuum gas oil into a bottom portion of a first counter current contractor column and introducing NMP into a top portion of the first column. The oil and NMP are mixed within the first column, and the treated oil is removed from the top portion of the first column. The treated oil is then introduced into a bottom portion of a second counter current contractor column along with NMP into a top portion of the second column. The treated oil and NMP are mixed and the treated oil is removed from the top of the second column. The second produce is introduced into a bottom portion of a third counter current contractor column and NMP is introduced into a top portion of the third column. These are mixed together with a treated oil being removed from the top portion of the third column. The third product and glycerin are then introduced into a receptacle, such as a kettle, static mixer, or pipe line where they are mixed and heated. This mixture is removed from the receptacle and introducing into a centrifuge. The centrifuge separates the oil product from the glycerin.

The method may also include moving the treated oil through an incline plate clarifier after removal from the first column and before introduction into the second column.

The method may also include delivering the oil to the first column and preventing contact with the oxygen thereby reducing the amount of oxidation to the oil.

The method may also include preventing mixing within a top area of the first column and removing Remo from the top area.

The method may also include introducing water into the receptacle with the glycerin and the third product.

Another embodiment is directed to a method of removing impurities from vacuum gas oil. This method includes moving a vacuum gas oil through one or more counter current contractor column processes each including introducing the oil and NMP into the column, mixing the contents, and removing the treated oil. The method also includes introducing the treated oil removed from the last column into a receptacle, and introducing glycerin into the receptacle. The treated oil and glycerin are mixed and heated in the receptacle and the contents are removed and placed into a centrifuge. The centrifuge is operated to separate and oil product from the glycerin.

The method may include moving the first product through an incline plate clarifier after removal from the first column and before introduction into the second column.

The method may include delivering the oil to the first column and preventing contact with the oxygen thereby reducing the amount of oxidation to the oil.

The method may include preventing mixing within a top area of the first column and removing Remo from the top area.

The method may include introducing water into the receptacle with the glycerin and the third product.

Another embodiment is directed to a method of removing impurities from vacuum gas oil. The process includes mixing a vacuum gas oil and NMP in one or more processes that each includes moving the oil upward through a column and moving NMP downward through the column. The treated oil is removed from the last column and introduced into a receptacle. Glycerin is also introduced into the receptacle. The treated oil and glycerin are mixed and treated in the receptacle. The contents are removed from the receptacle and introduced into a centrifuge. The centrifuge is operated and the contents are separated into an oil product and the glycerin.

The various aspects of the various embodiments may be used alone or in any combination, as is desired.

DETAILED DESCRIPTION

Figure 1:
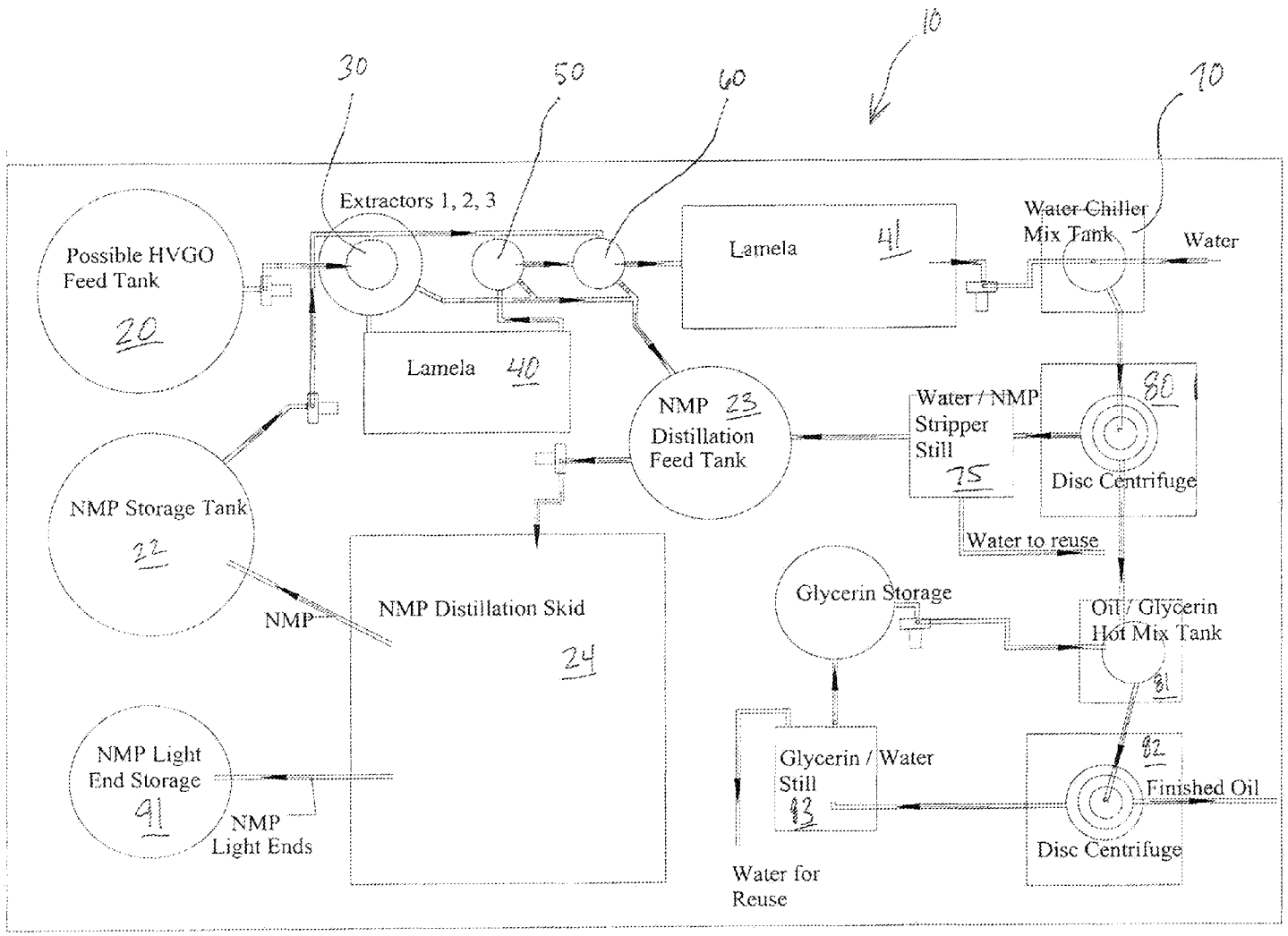
FIG. 1 is a schematic view of a decolorization system for removing color bodies from used oil.

The present application is directed to a process of removing color bodies from used oil. FIG. 1 illustrates one embodiment of a decolorization system 10 that illustrates the various operations performed during the process.

Initially, Vacuum Gas Oil or Heavy Vaccum Gas Oil (VGO) is maintained in a storage tank 20 under a blanket of inert gas. The tank 20 may be fed with VGO from a distillation column in an associated refinery. The VGO is pumped directly from the column to the decolorization system 10 through a pipeline so as to not let any oxygen come in contact with the VGO. Contacting the VGO with oxygen oxidizes the VGO thereby making it considerably darker in color and requiring more N-Methyl-2-pyrrolidone (NMP) to reduce the color bodies.

The system further includes a storage tank 22 that contains NMP. The use of NMP for the absorption of particular types of undesirables in lubrication base oils is well documented within the oil refining industry. The advantages of NMP over other solvents as a lubricating oil extraction solvent for the removal of undesirable aromatic and polar constituents from lubricating oil base stocks are known in the art. In particular, NMP is chemically stable, has low toxicity, and has the ability to produce refined oils of improved quality as compared with other known solvents.

The process includes cooling the VGO to a desired temperature and heating the NMP to the same desired temperature. This temperature is between 90 degrees F. and 230 degrees F. In one embodiment, the preferred temperature is 140 degrees F.

Figure 2:
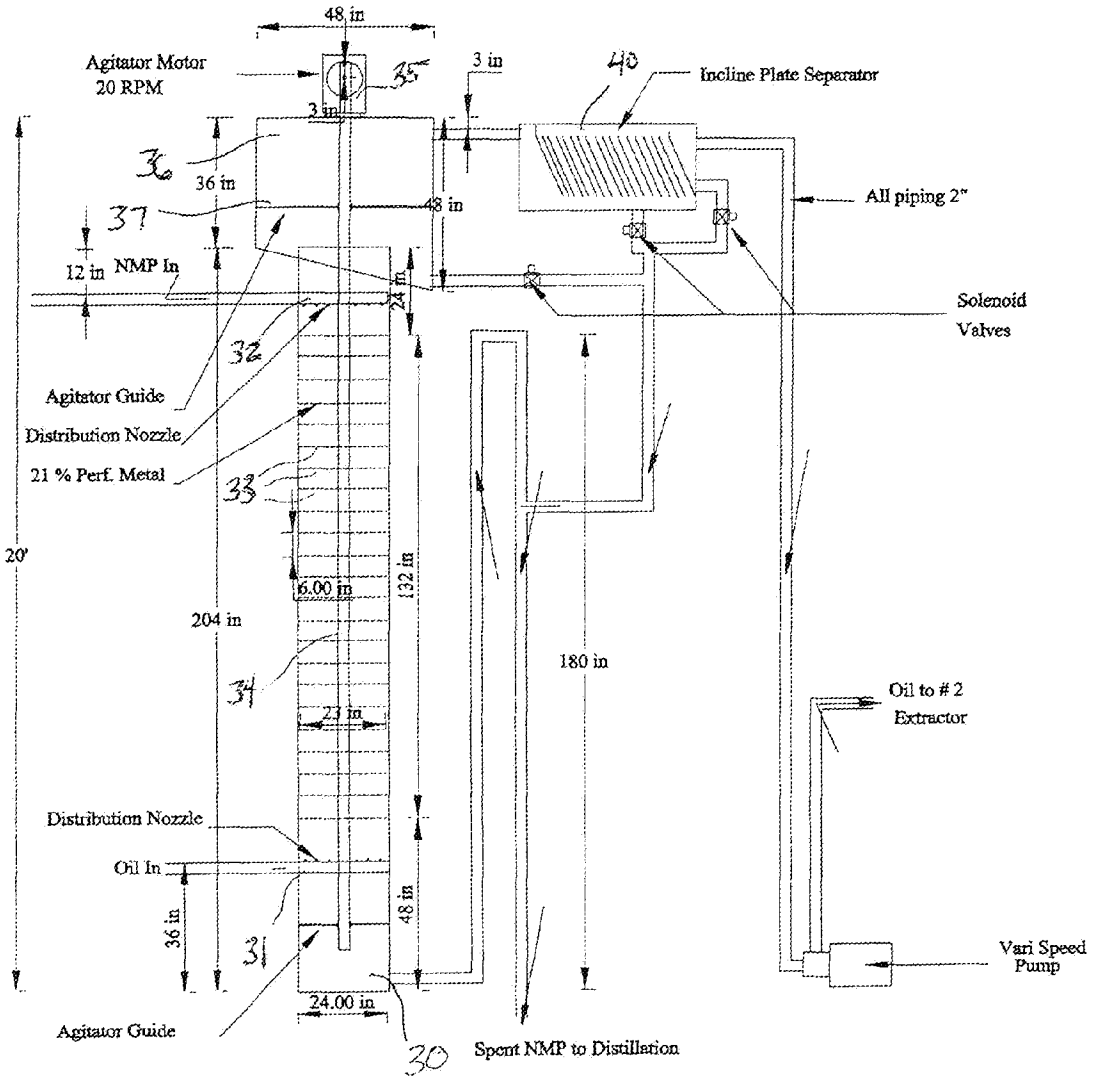
FIG. 2 is a side schematic view of a first column and a clarifier.

The oil is then introduced into a first counter current contactor column 30. FIG. 2 illustrates one embodiment of a column 30. The oil is introduced through an inlet 31 positioned in proximity to a bottom of the column 30. The NMP is introduced through a second inlet 32 positioned in proximity to a top of the column 30. The column 30 has a series of mixing discs 33 that are mounted to a central shaft 34. The shaft 34 is attached to an agitator 35 having a variable speed motor on an eccentric shaft.

Figure 3:
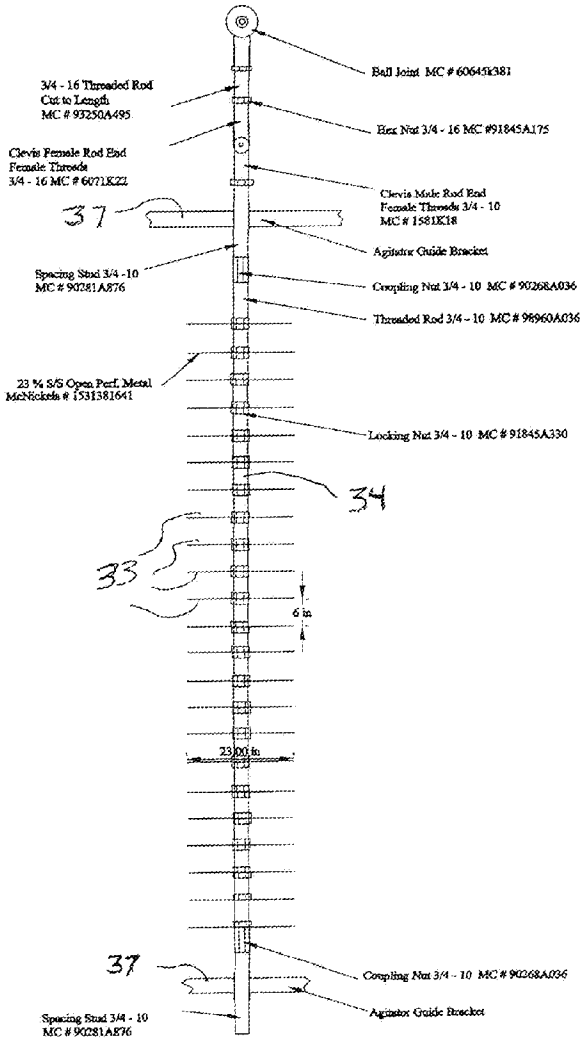
FIG. 3 is a side schematic view of a shaft and discs.

FIG. 3 illustrates one embodiment of the interior section of the column 30. The discs 33 are spread apart along the length of the shaft 34. In one embodiment, the discs 33 are spaced about 6 inches apart along the length of the shaft 34. The discs 33 include an enlarged shape to extend across the interior of the column 30. In one embodiment, the discs 33 are sized to extend across the column 30 and be spaced about 1 inch away from the column wall. The discs 33 may include openings to further mix the oil and NMP and to allow the passage of the materials. The openings are spaced about the discs 33 in various arrangements and locations. In one specific embodiment, the openings extend across 21% of the area of the discs 33. In one embodiment, the discs have holes or perforations equaling 21% open space of the area of the disc. The passage of the oil and NMP occurs through the openings and through the clearance formed between the discs 33 and the side of the column 30.

One or more guide brackets 37 may extend across the column 30. The guide brackets 37 include an opening to receive the shaft 34 to maintain the positioning within the interior of the column 30

The agitator 35 moves the shaft 34 and discs 33 in an up-and-down motion within the column 30. The agitator 35 may operate at a speed between 1 RPM and 30 RPM, with one preferred embodiment including a speed of 6 RPM. The agitator 35 is further configured such that each upward motion and each downward motion of the shaft 34 and discs 33 is between 0.1 and 6.0 inches. In one preferred embodiment, the motion is 1.0 inch.

The amount of oil to NMP introduced into the column 30 varies depending upon the quality of the oil being inputted into the system 10 and the desired quality of the outputted oil. The ratio of oil to NMP introduced into the column 30 may vary, with a low ratio being 6:1 and a high ratio being 1:2. The NMP is more dense and tends to fall through the column 30 while the oil is less dense and tends to rise through the column 30. The oil and NMP mix and the NMP solubilizes the undesirables in the oil. This process removes a majority of the impurities in the oil.

The oil may also contain an amount of non-solubilized material which contains additive packages that are added to the oil by lubricating compounders. This material leaves the solubility of the oil, but doesn't solubilize into the NMP. This material is known and referred to as Remo. The Remo produces an interface between the NMP and the treated oil as a black separate flock like material. If too much agitation or velocity exists within the column 30, the Remo will start to float up through the oil and contaminate the treated oil. The amount of Remo coming up the column 30 thus regulates the amount of travel and speed of the discs 33 and shaft 34.

An area 36 at the top of the column 30 is configured to capture the Remo. In one embodiment, the column 30 has a height of 17 feet, with the area 36 including the top 4 feet of the column 30. The area 36 may also be positioned beyond (i.e., above) the discs 33 such that no agitation occurs. In one embodiment, the area 36 is four times the capacity of the same length of column. This area 36 is configured to slow down the velocity of the oil and to allow a large amount of the Remo to collect at the bottom of the area 36.

As best illustrated in FIG. 2, the area 36 includes a larger diameter than a remainder of the column 30. In one embodiment, the area 36 includes a diameter of 4 feet with a remainder of the column 30 including a diameter of 2 feet. The smaller diameter portion of the column 30 may extend into the larger area 36. In one embodiment, the bottom of the area 36 is angled with the height of the area 36 varying between 3-4 feet. The smaller diameter portion extends 1 foot into the area 36. The Remo flows upward through the smaller diameter portion of the column 30 facilitated by the discs 33 and moves into the area 36. Within the area 36, the Remo encounters a velocity drop thereby causing it to settle into the outer portions of the area 36. The angled lower surface of the area 36 causes the Remo to settle into a lower portion. Valves may be positioned at this bottom area to remove the Remo. The dimensions of the area 36 may vary, provided it is configured to produce a pressure drop for the Remo to precipitate to the bottom of the area 36.

The now used NMP is collected from the bottom of the column 30. The NMP is processed through an NMP distillation area that includes one or more distillation tanks 23, 24. The used NMP is distilled and then introduced back into the NMP tank 22 for use again within the system 10. The NMP light ends may be introduced into a second storage tank 91.

The treated oil is then removed from a top of the first column 30 and moved through an incline plate clarifier 40. The clarifier 40 removes additional Remo and NMP from the oil. The clarifier 40 is of an incline plate nature, commonly referred to as a lamella in the water treatment industry. In one embodiment, the clarifier 40 is sized as to give a residency time of at least 4 hours. In one embodiment, the clarifier 40 has dimensions of 4 feet by 8 feet by 9.4 feet. The clarifier 40 provides for NMP and Remo to settle out from the oil. The Remo and small amounts of NMP are removed from a bottom of the clarifier 40 and sent to the NMP distillation system 29 where the NMP is reclaimed and the Remo becomes still bottoms.

Figure 4:
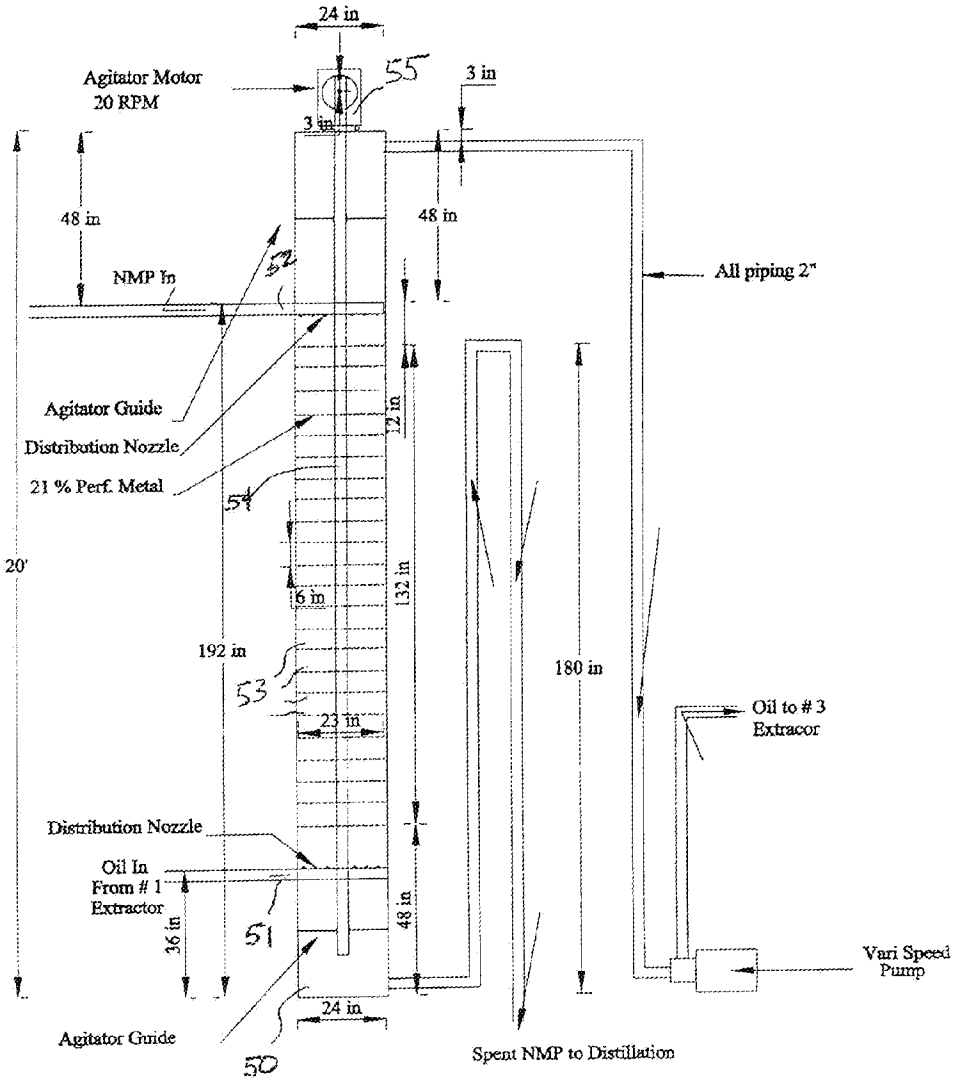
FIG. 4 is a side schematic view of a second column.

The treated oil is next moved out of a top of the clarifier 40 and into a second counter current column 50. FIG. 4 illustrates one embodiment of a second column 50. The oil is introduced through an inlet 51 at a bottom of the column 50. Clean NMP is introduced through an inlet 52 at a top of the second column 50. The second column 50 includes discs 53, a shaft 54, and an agitator 55 and operates in the same manner as the first column 30. The NMP solubilizes additional amounts of the color bodies and undesirables. The amount of Remo generated in the second column 50 is minimal. Therefore, the column 50 does not include an enlarged area for their removal (as included as area 36 in the first column 30).

The used NMP is collected from the bottom of the column 50. The NMP is processed through the NMP distillation system and introduced back into the original NMP tank 22 for use again within the system 10.

Figure 5:
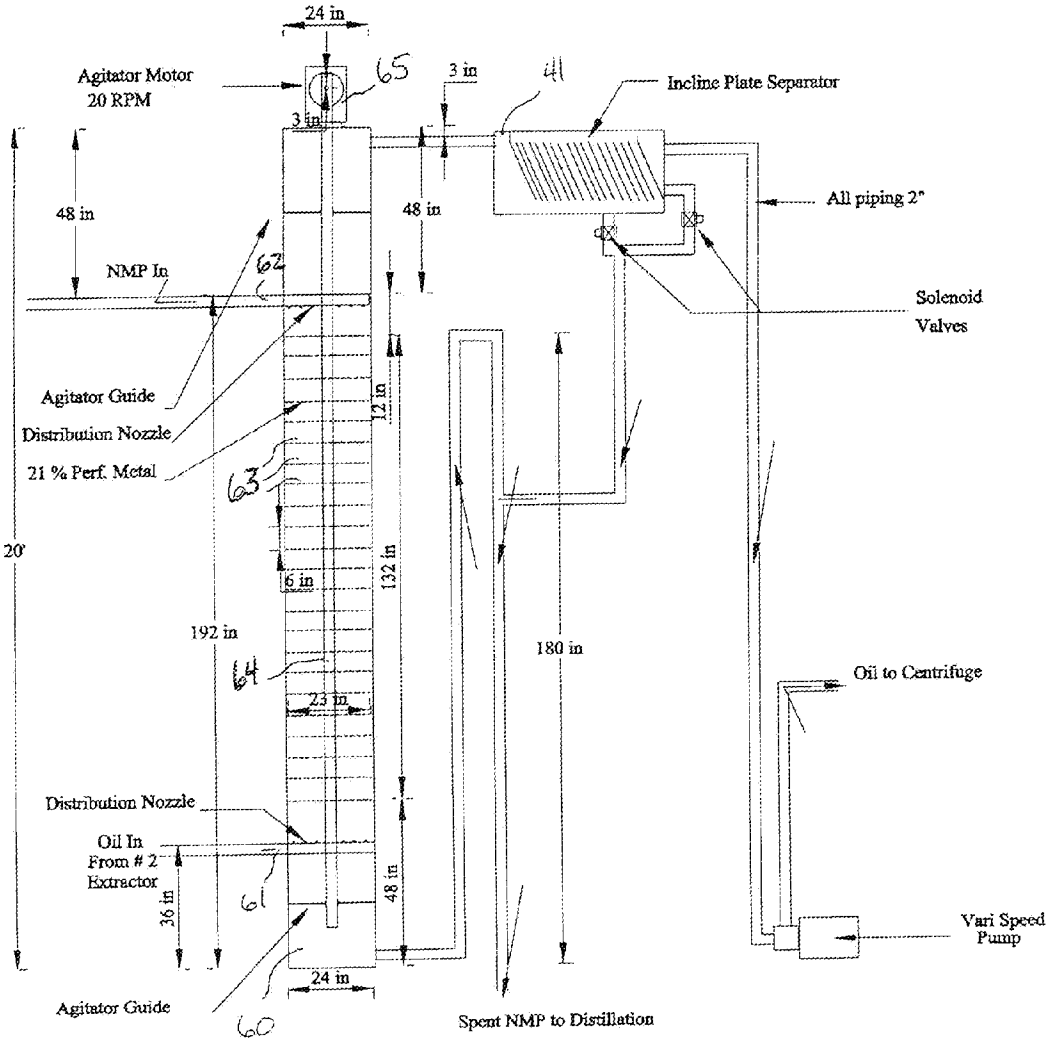
FIG. 5 is a side schematic view of a third column and a second clarifier.

The oil moves to the top of the second column 50 where it is removed and then introduced into a third column 60. FIG. 5 illustrates one embodiment of a third column 60. The oil is introduced through an inlet 61 at a bottom of the column 60, and additional NMP is introduced through an inlet 62 at a top of the column 60. The third column 60 includes the same structure as the first column 30 with discs 63, a shaft 64, and an agitator 65. The third column 60 operates much the same as the second column 50.

A difference with the third column 60 is that a greater amount of NMP is added to maximize the solubility of the undesirables and remove them from the oil. The amount of NMP added in the third column 60 may vary depending upon the desired quality of the finished product. The ratio of oil to NMP may range from 6:1 to 1:1. Typically, the ratio of oil to NMP is about twice the ratio used in the first two columns 30, 50. By way of example, if the first and second columns 30, 50 use an oil to NMP ratio of 4:1, then the third column 60 includes a ratio of 2:1.

In some embodiments, a clarifier 41 is located downstream from the third column 60. The clarifier 41 includes the same structure and design as the first clarifier 40 and removes Remo and NMP from the oil. Typically, there is a very minimal amount of Remo after the third column 60 and a second clarifier is not necessary. In one embodiment, the clarifier 41 has dimensions of 5.1 feet by 10.7 feet by 15 feet.

Remaining NMP is removed from the bottom of the column 60 and moved to the NMP distillation area where the NMP is reclaimed and returned for use again in the system 10.

The oil with about 7% NMP flows out of the second lamela 41 to a water chiller mix tank 70. Water and a demulsifier are also added as the oil enters the tank 70. In one embodiment, the water is added at a rate to account for between 10%-25% of the material in the tank 70, with 15% being desired. Demulsifier is added to a total of 2000 parts per million (PPM). The tank 70 includes a slow speed mixer to continuously mix the contents. The tank 70 also includes a chiller to continuously cool the contents. The temperature of the contents in the tank 70 is cooled to between 50° F.-100° F., with a preferred temperature of 70° F.

The contents are removed from the tank 70 at a rate to maintain the temperature within the desired range. The chilled contents are then pumped to a high speed disc centrifuge 80 where the NMP and water are centrifuged out of the oil. In one or more embodiments, the water is completely removed. In other embodiments, a majority of the water is removed, however, some residual water remains with the oil after being treated with the centrifuge 80. The water/NMP phase of the contents is pumped to a water/NMP stripper still 75 where the water is distilled off and sent for re-use. The recovered NMP is sent to the NMP distillation feed tank 23.

The centrifuge 80 may be a three phase disc type or a three phase tubular type. It has been determined that the three phase disc type is desirable. A high speed solid bowl centrifuge may be added in front of a disc or tubular type centrifuge if a 2-phase centrifuge is used, or if a large solids loading is experienced on these centrifuges. High solids loading may occur because of improper treatment through the columns 30, 50, 60 or increased velocity through the columns 30, 50, 60 to increase oil output.

The oil is then pumped to an oil/glycerin hot mix tank 81. Glycerin is added to the oil in the amount between 2%-20% with 5% being most favorable. In one embodiment, the oil is heated to a temperature of 200° F. prior to adding the glycerin. In one embodiment, the glycerin that is added is at a temperature considerably below that of the oil. In one embodiment, the glycerin has a temperature of between 150° F.-220° F. with 200° F. being most favorable when added to the oil. In another embodiment, the glycerin and oil are both at a relatively low level when the glycerin is initially introduced, and the mixture is then heated to a temperature of between 150° F.-220° F. with 200° F. being most favorable.

The oil/glycerin mixture is then pumped to a second high speed disc centrifuge 82 where the trace water and glycerin are centrifuged out of the oil. In one or more embodiments, the water and glycerin are completely removed from the oil. In other embodiments, a majority of the water and glycerin are removed, however, some residual water remains with the oil after being treated with the centrifuge 80. The water and glycerin are removed and pumped to a glycerin/water still 83 where the water is distilled off for reuse and the glycerin is pumped to a glycerin storage tank 77 for reuse.

The oil from the centrifuge 82 is pumped to finished oil storage. The grade of the finished oil may depend mainly of the VGO feed stock. The finished oil is generally the same as that which is input into the system. For example, if a VGO feed stock being processed is a Group I, typically the oil will finish as a Group I. In one embodiment, however, if a Group I VGO feedstock is close to being a Group II, than the removal of asphaltines and aromatics could push the finished oil into a Group II category. In one embodiment, the updated process removes the residual NMP to less than 0.01%.

In one embodiment, the system 10 disclosed in FIG. 1 encompasses an area of 30 feet by 41 feet.

Figure 6:
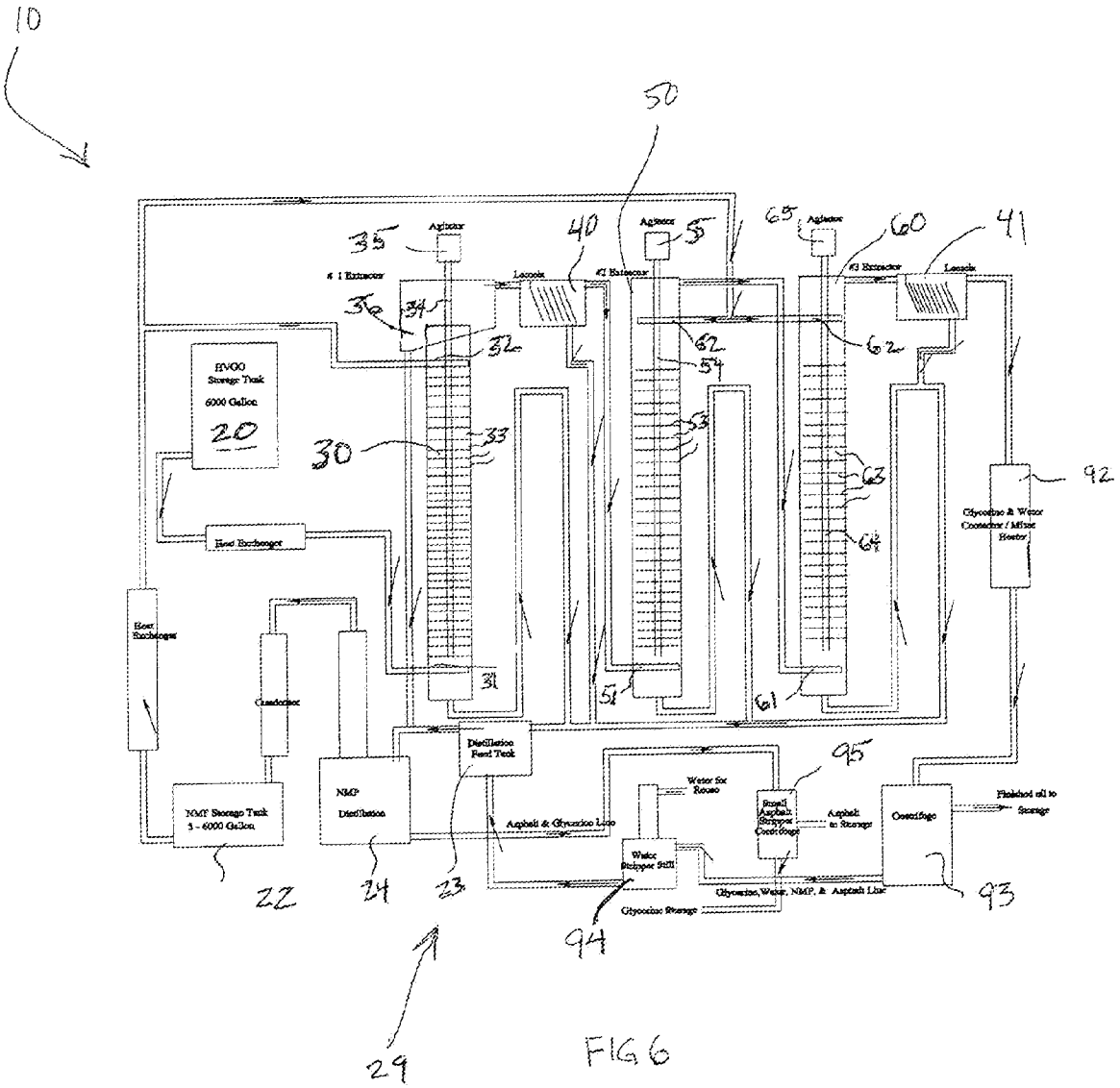
FIG. 6 is a side schematic view of a decolorization system for removing color bodies from used oil.
Figure 7:
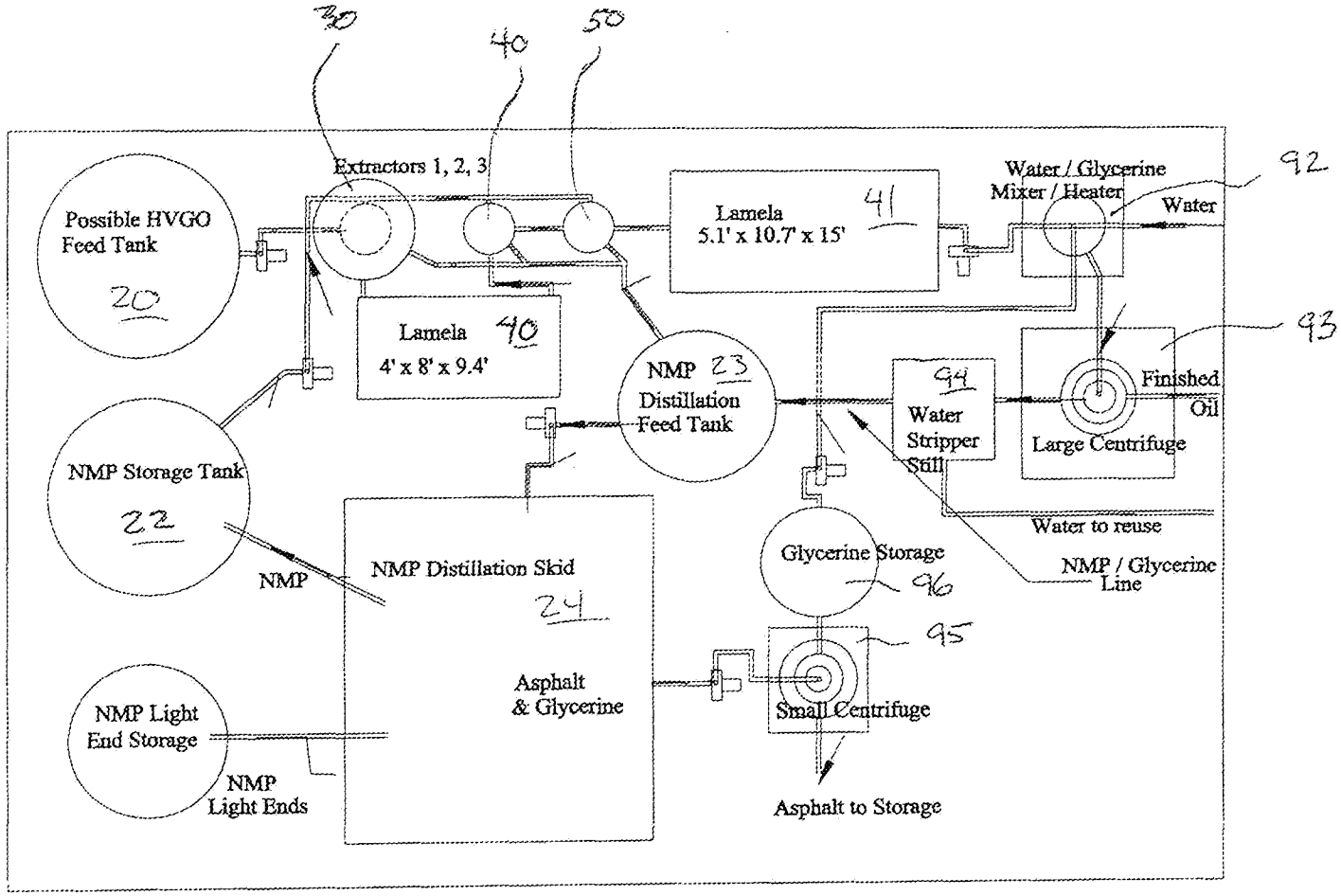
FIG. 7 is a schematic view of a decolorization system for removing color bodies from used oil.

FIGS. 6 and 7 illustrate other embodiments of processes of removing color bodies. The beginning steps of the process are the same as the previous process and including moving the oil through between one, two, or three columns 30, 40, 50 and a first lamella 40. The process may also include moving the oil through a second lamella 41.

The treated oil is moved from the top of the third column 60 (or second clarifier 41 if applicable) to a mixing receptacle 92, such as a kettle, tank, static mixer, or pipe line. The mixing receptacle 92 is equipped with a heater to continuously heat the contents. The mixing receptacle 92 also includes a slow speed mixer to continuously mix the contents. In one embodiment, the mixer mixes continuously at approximately 30 RPM. Glycerin, water, and a demulsifier are added as the oil enters the receptacle 92. The glycerin is added at a rate between 1% and 20%, with a preferred amount being 10%. Water is added at a rate between 1% to 6%, with 3% being desired. Demulsifier is added at a rate of 10 PPM to 1000 PPM, with 50 PPM being desirable.

The contents of the receptacle 92 including the oil, glycerin, water, and demulsifier are mixed and heated continuously and removed from the bottom of the receptacle 92. The removal rate is set to keep the contents of the receptacle 92 at a temperature between 80° F.-210° F., with 180° F. being desirable. The glycerin and water are very polar solvents that solubilize and add weight to the remaining NMP that carries over with the oil. The NMP carry over ranges from 2% to 6% depending on velocity through the columns 30, 50, 60. The demulsifer acts to separate the NMP, glycerin, and water from the oil.

The mixture is removed from the receptacle 92 and moved to a centrifuge 93. The centrifuge 93 may be a three phase disc type or a three phase tubular type. It has been determined that the three phase tubular type is desirable. A high speed solid bowl centrifuge may be added in front of a disc or tubular type centrifuge if a 2-phase centrifuge is used, or if a large solids loading is experienced on these centrifuges. High solids loading may occur because of improper treatment through the columns 30, 50, 60 or increased velocity through the columns 30, 50, 60 to increase oil output.

In one embodiment, the oil leaving the one or more centrifuges 93 will be of a quality of Group 2 base oil lubricant, with sulfur under 300 PPM, NOAK less than 15, color of 0.5 to 2, and residual NMP of between 0.04-0.50%. In one embodiment, the residual NMP is less than 0.01%. The centrifuges 93 operated by one familiar with the art can also be operated to produce a Group 1 lubricant if desired. The finished oil is pumped to product storage.

The mixture of NMP, glycerin, and water removed at the centrifuge 93 is pumped into a water stripper still 94. The water is distilled off the mixture and the water is returned to be reused within the process. The NMP and glycerin are pumped to the NMP distillation area where the NMP is distilled over for reuse within the process. The glycerin has a higher distillation temperature and becomes heavy distillation mixture along with any Remo, residual carry over oil, and undesirables. This heavy distillation mixture leaves the tank 24 and is processed through a high speed disc type centrifuge 95 that separates the heavy oil and undesirables from the glycerin. In one embodiment as illustrated in FIG. 7, the glycerin is returned to a storage tank 96, and the heavy oil and undesirables are moved to a separate storage and may be marketed as asphalt flux. In one embodiment, the system illustrated in FIG. 7 is arranged in an area of 30 feet by 40 feet.

The various processes described above include moving the oil through three separate columns 30, 50, 60. Other processes may include moving the oil through fewer than three columns, or more than three columns. The various columns may be substantially the same, or the columns may include different structures.

Another aspect of the system provides for the treatment of contaminated base and compounded oil line wash. Contaminated base and/or compounded oil line wash is generated when one product in a pipe line is replaced with a different product. This happens due to the changing of an oil in the pipe line to a different oil to produce a specific specification in the finished compounded oil. It may also occur when unloading oils into specific tanks through a common pipe line header, or may occur when changing a compounded oil in packaging to a different compounded oil or with the addition of a new pipe line being put into service and the construction contamination is washed out of the pipe line before production occurs. These pipe lines may be washed with oils and/or water producing a contaminated oil.

Currently the state of the art is to take these contaminated oils and blend them into waste or recycled oils that are sold for a much lower price than the product they came from, or by heating the oil hot enough to distill the water from the oil. However, in doing this the oil becomes quite dark in color and ultimately is used in the low cost recycled oil industry.

The present system 10 is configured to remove these contaminates and brings the line wash oil back to its intended use. Removal of these contaminates may include processing the oil through just a limited portion of the system 10, or through the entirety of the system 10.

In one embodiment in which the oil is just contaminated with water, the line wash is introduced to the system at a point between the centrifuge 80 and the oil glyercin mix tank 81 (see FIG. 1). In one embodiment, the system includes a separate pipe line to introduce the oil at this point such that the oil does not move through the earlier sections of the system (i.e., the oil does not move through the columns 30, 40, 50, lamelas 40, 41, tank 70, and centrifuge 80). When the oil is introduced at this point in the system 10, glycerin is mixed with the oil in the tank 81, and then the water is then removed from the oil in the disc centrifuge 82 in a similar manner as previously described.

In another embodiment, after the oil and glycerin are mixed in tank 81, the mixture does not move through the centrifuge 82. Instead, the mixture remains in the tank 81 and the process includes decanting the water and glycerin off the bottom of the tank 81. This produces an oil equal to the original oil water free.

In one embodiment, the mixture remains in the tank 81 where the decanting occurs. In another embodiment, the mixture is moved from tank 81 to a separate tank (not illustrated in FIG. 1). The decanting is then performed at this separate tank.

The removal of line wash may be a separate process, or may be used in conjunction with the normal operations of the system 10 in removing color bodies in used oil process and injecting the line wash during production runs. In one embodiment, the line wash is introduced into the system 10 independently when no other oil is being processed in the system 10. In another embodiment, the line wash is introduced into the system 10 while the system is in production (i.e., removing color bodies in used oil).

In another embodiment, the line wash process uses a larger portion of the system 10. If, for example, the oil to be treated has water and color contamination. Then, the line wash is introduced into the feed tank 20, or otherwise introduced into the system upstream from the initial column 30. This may include a direct pipe into a feed pipe into the column 30, or directly into the column 30 itself. This oil would run through and be processed by the system 10 in a similar manner as described above for removing color bodies from used oil.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A method of removing color bodies from vacuum gas oil comprising:

mixing the oil and N-Methyl-2-pyrrolidone (NMP) within one or more columns;

removing a first portion of the NMP from the oil by movement through the one or more columns;

after moving through the one or more columns, adding water and glycerin to the oil; and removing a second portion of the NMP, at least some of the water, and at least some of the glycerin from the oil through at least one centrifuge.

2. The method of claim 1, further comprising:

adding the water to the oil;

moving the oil with the water through a first one of the centrifuges and removing additional parts of the NMP from the oil;

thereafter, adding the glycerin to the oil; and moving the oil with the glycerin through a second one of the centrifuges and removing more of the NMP from the oil.

3. The method of claim 2, further comprising:

adding the water and chilling the oil to between 50° F.-100° F.; and removing the second portion of the NMP and a first portion of the water from the oil with the first centrifuge.

4. The method of claim 2, further comprising adding a demulsifier to the oil when adding the water.

5. The method of claim 2, further comprising moving the oil and the NMP through an incline plate clarifier and removing an additional amount of the NMP prior to adding the water and the glycerin.

6. The method of claim 1, further comprising moving the oil from a first location to the one or more columns while preventing contact between the oil and oxygen.

7. A method of removing color bodies from vacuum gas oil comprising:

introducing the oil into a first inlet at a lower section of a contactor column;

introducing N-Methyl-2-pyrrolidone (NMP) into a second inlet at an upper section of the contactor column, the NMP being more dense than the oil;

mixing the oil and the NMP along the contactor column with an agitating member that moves in upward and downward directions along a height of the contactor column, the agitating member including a shaft and radial discs spaced apart along the height of the contactor column;

moving non-solubilized material in the oil upward in the contactor column and into a capture area at the upper section, the capture area being positioned above the agitating member and including a greater width than the contactor column along the agitating member;

reducing a velocity of the non-solubilized material in the oil in the capture area with the non-solubilized material settling into a lower section of the contactor column;

removing the oil that has been treated from the upper section of the capture area, the treated oil including a residual amount of NMP;

after the treated oil is removed, mixing glycerin and water with the treated oil with the glycerin being at a temperature of between 80° F.-220° F.; and removing an additional amount of the NMP and at least some of the glycerin and the water from the treated oil with a first centrifuge.

8. The method of claim 7, further comprising within the contactor column moving the oil and NMP through openings in the discs and along peripheral openings formed between a wall of the contactor column and an outer end of the radial discs.

9. The method of claim 7, wherein a ratio of oil to NMP introduced into the contactor column ranges from between 6:1 to 1:2.

10. The method of claim 7, further comprising moving the non-solubilized material along an angled lower member of the capture area towards an outlet.

11. The method of claim 7, further comprising removing a majority of the NMP that was introduced into the second inlet from the lower section of the contactor column.

12. The method of claim 7, further comprising moving the treated oil through a second contactor column prior to mixing the glycerin and the water with the treated oil.

13. The method of claim 7, further comprising moving the oil from a first location to the contactor column while preventing contact between the oil and oxygen.

14. The method of claim 7, further comprising moving the non-solubilized material in the oil in the contactor column vertically above the second inlet and removing the treated oil from the contactor column at a point vertically above the second inlet.

15. A method of removing color bodies from vacuum gas oil comprising:

mixing the of with NMP in a first contactor column with the oil moving upward through the first contactor column and the NMP moving downward through the first contactor column:

removing the oil from an upper section of the first contactor column and introducing the oil into a second contactor column, the oil including a first amount of the NMP;

mixing the oil in the second contactor column with a second greater ratio of NMP and mixing the oil and the NMP with the oil moving upward through the second contactor column and the NMP moving downward through the second contactor column;

removing the oil that includes a second amount of NMP from an upper section of the second contactor column;

mixing the oil that includes the second amount of NMP with water and a demulsifier within a first tank and cooling to a temperature of between 50° F.-100° F.;

moving the first tank contents into a first centrifuge and removing at least a portion of the NMP and at least a portion of the water from the oil;

mixing contents of the first centrifuge with glycerin and heating to a temperature of between 150° F.-200° F.;

removing at least a portion of the glycerin and at least a portion of the water from the oil with a second centrifuge.

16. The method of claim 15, further comprising the water comprising 15% of the first tank contents.

17. The method of claim 16, further comprising cooling the first tank contents to a temperature of 70° F. prior to moving the first tank contents to the first centrifuge.

18. The method of claim 15, further comprising moving the oil from the second centrifuge into a finished oil storage tank.

* * * * *